United States Patent [19]

LaFollette et al.

[11] 3,946,698

[45] Mar. 30, 1976

[54] INBOARD-OUTBOARD DRIVE FOR MARINE VESSEL

[75] Inventors: Robert L. LaFollette, Baldwinsville; Kenneth H. Miller, Syracuse, both of N.Y.

[73] Assignee: American Challenger Corporation, Louisville, Colo.

[22] Filed: Aug. 29, 1974

[21] Appl. No.: 501,841

[52] U.S. Cl. ..... 115/35

[51] Int. Cl.[2] ..... B63H 1/14

[58] Field of Search ..... 115/34 R, 35, 37, 18 R; 114/144 R, 150, 154–161

[56] References Cited

UNITED STATES PATENTS

| | | | |
|---|---|---|---|
| 2,422,139 | 6/1947 | Sheridan | 114/144 R |
| 2,755,766 | 7/1956 | Wanzer | 115/35 |
| 2,988,039 | 6/1961 | Nimmo et al. | 115/35 |
| 3,175,530 | 3/1965 | Petterson | 115/35 |
| 3,447,504 | 6/1969 | Shimanckas | 115/34 R |
| 3,596,626 | 8/1971 | Buddrus | 115/35 |
| 3,605,677 | 9/1971 | Bergstedt | 115/35 |
| 3,756,188 | 9/1973 | Smith | 115/35 |

FOREIGN PATENTS OR APPLICATIONS

| | | | |
|---|---|---|---|
| 995,658 | 6/1965 | United Kingdom | 115/35 |

*Primary Examiner*—Trygve M. Blix
*Assistant Examiner*—Jesus D. Sotelo
*Attorney, Agent, or Firm*—Woodcock, Washburn, Kurtz & Mackiewicz

[57] ABSTRACT

An inboard-outboard drive is taught having an upper, approximately horizontal input shaft; an output shaft substantially parallel thereto for driving a propeller; and a vertically-oriented intermediate shaft coupled to the other shafts by suitable gearing. The upper and lower shafts are journaled in upper and lower housings, respectively. A tubular member disposed coaxially with the intermediate shaft couples the upper and lower housings, allowing the lower housing to rotate with respect to the upper housing. The tubular member is associated with a steering member opposite sides of which are coupled to ones of a pair of hydraulic cylinders disposed within the upper housing. In one embodiment the steering member comprises a pinion which is rotated by rack gears coupled to the hydraulic cylinders and adapted to slide back and forth in ways formed in the upper housing. In another embodiment, the steering member is a bellcrank keyed to the tubular member and coupled to the hydraulic cylinders by linkage arms.

14 Claims, 4 Drawing Figures

INBOARD-OUTBOARD DRIVE FOR MARINE VESSEL

BACKGROUND OF THE INVENTION

The present invention relates generally to drive means for marine vessels and, more particularly, to improved boat drives of the inboard-outboard variety.

For many years power boats were generally grouped into two categories, i.e., "outboard" and "inboard". The "outboard" type of boat, powered by a self-contained power drive unit mounted to the transom of the vessel, was commonly considered to be of a smaller and lighter type of boat then the "inboard" which was powered by a large internal combustion engine driving a propeller either directly through an intermediate gear box or through a drive shaft extending through the bottom of the boat.

Eventually, the inherent advantages in outboard-type propeller drives were recognized and the state of the art progressed to the point where it was feasible to manufacture drive units to be mounted outboard of a boat, but which were coupled to a source of motive power disposed within the boat itself. Thus, a hybrid drive system, termed the "inboard-outboard" drive came into being.

The inboard outboard drive mechanism, however, posed substantial problems. While it was desired to be able to adjust the drive both to cant it to its optimum attitude and to rotate it for steering purposes, much in the manner of an outboard motor arrangement, the drive must be large and rugged enough to absorb the power transmitted by large inboard-mounted engines. To reconcile these requirements, several approaches have been taken by the prior art. Commonly, the upper portion of the drive unit is hinged so that its attitude may be adjusted relative to the stern of the boat. Universal joints are interposed in the power input shaft for transmitting power from a fixed shaft extending either directly from the motor, or through a transmission attached thereto, to the input mechanism of the drive unit. Further, in order to achieve directional control the drive unit may also be gimbaled at the same point so that the entire outboard-mounted unit may be turned. In the past, turning has been achieved by providing external hydraulic cylinders attached to the transom of the boat and extending to an appropriate portion of the drive unit casing. By turning a sterring wheel, the operator of the boat controls a source of hydraulic pressure which in turn operates the hydraulic cylinders at the stern, causing the drive unit to turn and thus effect a change in the direction of the driven vessel.

The hydraulic units heretofore used for steering have commonly been adapted from automotove applications, and have typically comprised certain of the hydraulic elements from a power steering apparatus. While such units have proved adequate for many types of operation, their external mounting necessarily exposes them to injury and damage. Further, especially in salt water usage, the hydraulic elements are susceptible of corrosion which hampers their efficacy and materially shortens their useful life.

In another type of known drive unit, the unit is divided into an upper and a lower section, and a hinge apparatus provided so that the lower section may rotate relative to the upper section in order to provide directional control. This simplifies the drive system mounting, though posing steering control problems similar to those presented by the afore-described arrangement.

In U.S. Pat. No. 3,605,677 — Bergstedt there is disclosed a boat drive arrangement comprehending a steering control apparatus which overcomes some of the above-described problems. However, the hydraulically-driven rack arrangement requires custom-built dual-acting cylinders of rather complex design, and moreover necessitates a considerable increase in the width of the drive unit which increases the projected area thereof.

It will therefore be appreciated that it would be advantageous to provide a simplified, compact steering means for achieving directional control of an inboard-outboard drive, the elements of which are protected from corrosion and damage.

It is therefore an object of the present invention to provide an inboard-outboard drive unit having a superior directional control mechanism.

It is another object of the present invention to provide an inboard-outboard drive having an improved steering apparatus enclosed therewithin.

It is still another object of the invention to provide an improved steering apparatus in an inboard-outboard drive unit which is compact enough to fit within the drive unit housing.

SUMMARY OF THE INVENTION

Briefly stated, in accordance with one aspect of the invention the foregoing objects are achieved by providing an upper and a lower drive housing, the upper housing having therein an input drive shaft adapted to receive power from a source of motive power, and the lower housing having an output drive shaft coupled to a propeller means. An intermediate shaft extends in a vertical manner from one housing to the other, connecting the input and output drive shafts through suitable gearing. A tubular element disposed concentrically with the intermediate shaft is journaled in one of the housings and fixedly attached to the other so that one housing may be turned with respect to the other rotating about the axis of the intermediate drive shaft. A steering means affixed to the tubular element is engaged at opposite sides thereof by first and second linkage means, each of the linkage means being disposed in opposite sides of the upper housing substantially parallel to the input drive shaft. A single-acting hydraulic cylinder is coupled to each of the linkage means, the linkage and cylinder assemblies being wholly enclosed within the upper housing.

In one embodiment, the steering means comprises a pinion, the linkage means being constituted by rack gears engaging opposite sides of the pinion. In another embodiment the steering means takes the form of a bellcrank, opposite sides of which are attached to the respective linkage means by pins.

BRIEF DESCRIPTION OF THE DRAWINGS

While the specification concludes with claims particularly pointing out and distinctly claiming the subject matter which is regarded as the invention, it is believed that the invention will be better understood from the following description of preferred embodiments taken in conjunction with the accompanying drawings in which:

DESCRIPTION OF PREFERRED EMBODIMENTS

Figure 1:
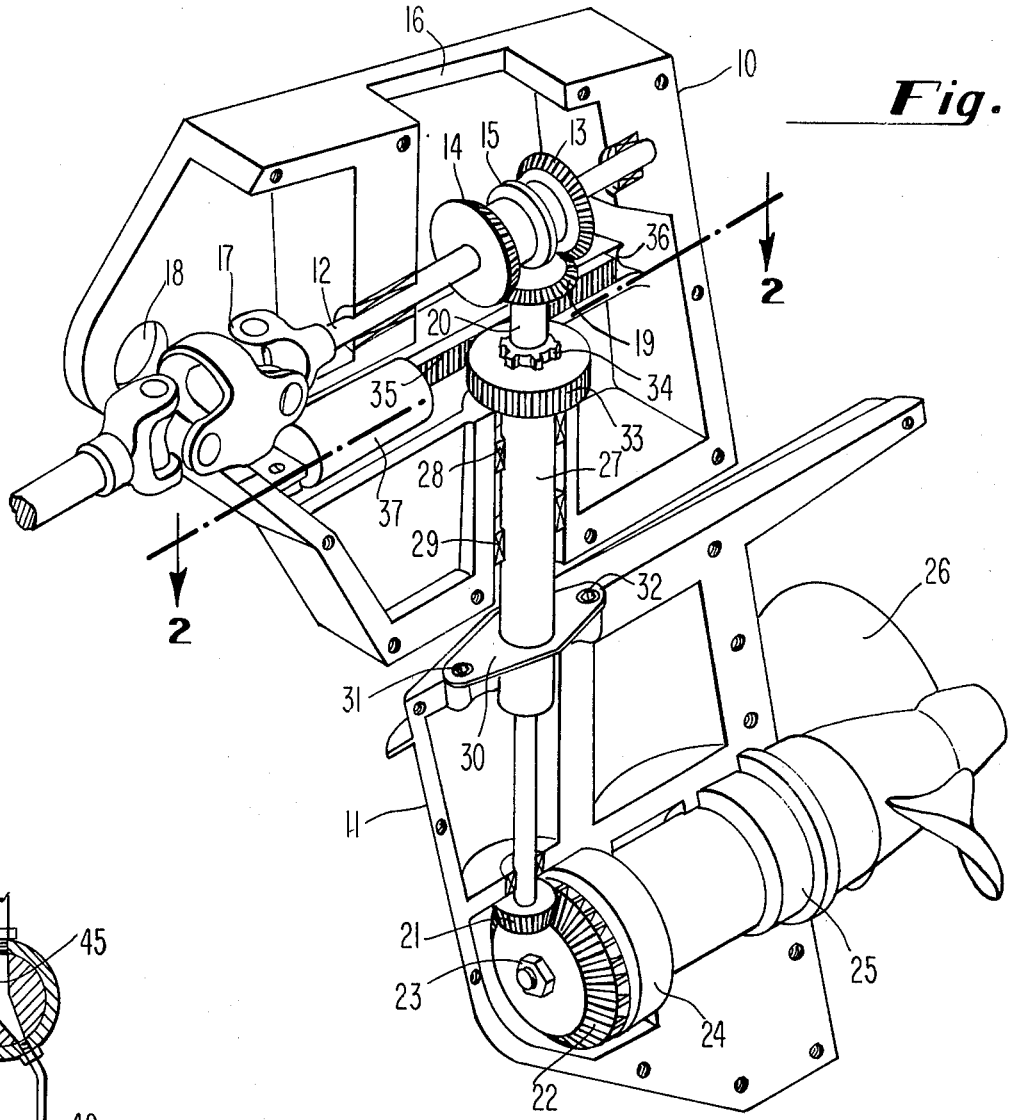
FIG. 1 is a cutaway drawing of apparatus embodying principles of the present invention.

FIG. 1 shows an inboard-outboard drive unit of a type adapted for use with the present invention and comprising an upper housing 10 and a lower housing 11. Journaled within the upper housing is an input drive shaft 12 having disposed thereon forward and reverse bevel gears 13 and 14, respectively. A shifting sleeve 15 disposed between the bevel gears receives shifting forks (not shown) through an opening 16 in the upper surface of the housing for selectively translating the gears axially upon input shaft 12. A universal joint assembly 17 is affixed to one end of shaft 12 and serves to couple the shaft to a source of motive power, such as a gasoline or diesel engine, located inboard the vessel to be driven. A trunnion assembly (not shown) rigidly affixed to the stern of the vessel, engages hole 18 in the manner of the hinge so that the drive assembly may be adjustably tilted to the proper attitude relative to the stern of the vessel.

An upper bevel gear 19 located at the upper end of an intermediate drive shaft 20 couples the shaft to input shaft 12 through the forward or reverse drive gear 13, 14 which has been meshed with gear 19 by the shifting forks. A similar gear 21 attached to the lower end of the intermediate shaft engages a mating gear 22 located at the forward end of output drive shaft 23. The output shaft is journaled in the lower housing 11 by suitable bearings 24, 25, it being anticipated that bearing 25 is provided with suitable seals for preventing leakage of water into, or oil out of, the unit. At the distal end of the output dirve shaft is a propeller means 26, which may be of any of the many well-known configurations, for providing the forward thrust to propel the vessel through the water.

Disposed concentrically about intermediate shaft 20 is a tubular member 27 which is rotatably located within upper housing 10 by means of bearings 28, 29. Other bearings (not shown) disposed within the tubular member 27 maintain the concentricity of the tubular member and shaft 20, and provide support and location therebetween. A flange 30 affixed near the lower end of the tubular member, is fastened to lower housing 11 such that the lower housing is constrained to turn with the tubular member. A pair of Allen head screws 31, 32 fasten flange 30 to the lower housing without projecting above the surface thereof so that the upper and lower housings can be maintained in close proximity with one another.

A pinion 33, which may take the form of a simple spur gear, is disposed near the upper end of the tubular member 27 and located thereon by any suitable means such as splines 34. In this manner, the tubular member 27 is constrained to rotate with the pinion gear. A rack gear 35 is slidingly disposed in ways 36 and extends in a generally fore-and-aft configuration, i.e., substantially parallel to input drive shaft 12. A hydraulic cylinder 37, advantageously of an economical self-contained single-acting design, is coupled to one end of rack 35 and adapted to push it rearwardly along ways 36 in response to the application of hydraulic pressure from a steering control unit. In this manner an extremely small and compact arrangement is provided for controllably rotating tubular member 27, and therefore lower housing 11.

Figure 2:
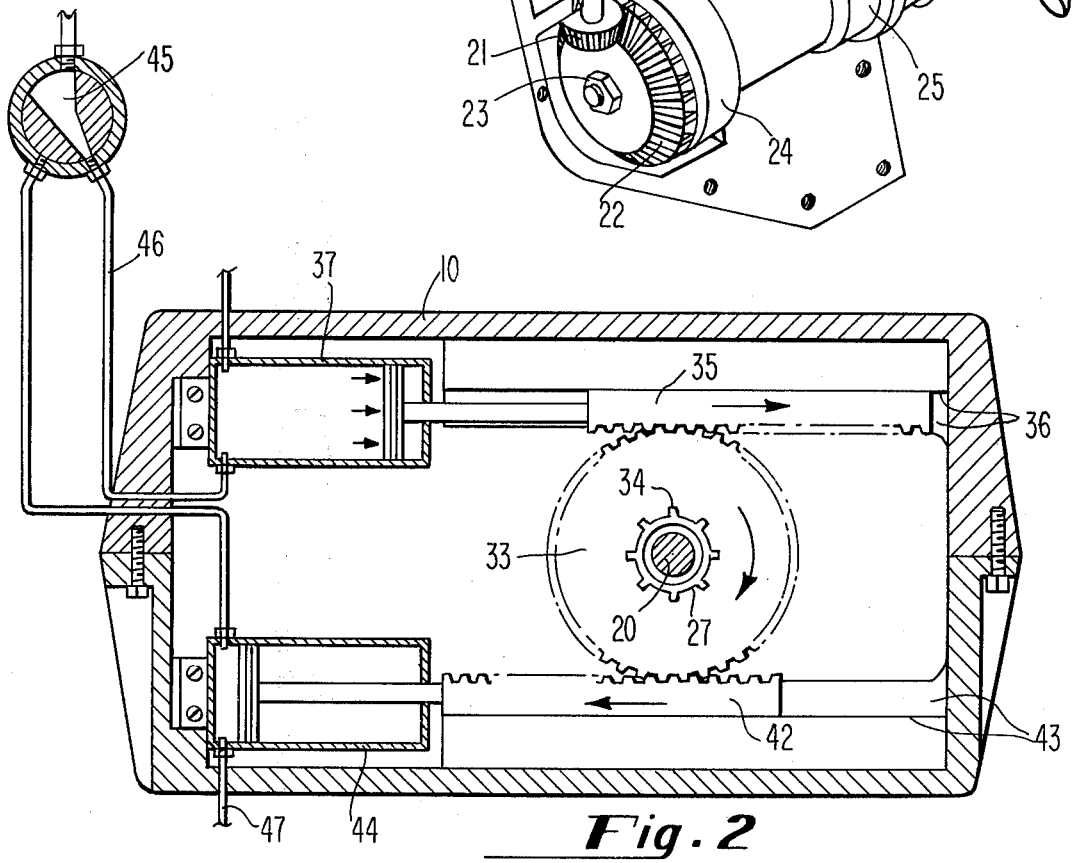
FIG. 2 is a sectional view taken at section 2—2 of FIG. 1.

Turning now to FIG. 2 there is shown in detail the construction and operation of the hydraulic steering mechanism when mating halves of upper housing 10 are assembled. Hydraulic cylinders 37, 44 are located in opposite halves of the housing, and are associated with a pair of linear rack gears 35, 42 which are slidingly located in ways 36, 43. Ways 36 and 43 advantageously comprise recesses having semicircular cross-section machined into the housings, and provide guides for precisely locating the racks as they are translated due to the action of the hydraulic cylinders 37 and 44, respectively. As will be recognized by those skilled in the art, since racks 35, 42 engage pinion gear 33 at substantially diametrically opposite points, they afford additional lateral support to the gear during the turning thereof. In the position depicted, an appropriate control such as a steering wheel assembly (not shown) operates valve 45 to allow pressurized hydraulic fluid to flow from a pump (also not shown) through line 46, increasing the pressure within hydraulic cylinder 37. At the same time, complementary valving allows fluid within hydraulic cylinder 44 to escape therefrom, returning to a common fluid reservoir by way of line 47.

As the pressure within cylinder 37 increases, the cylinder piston is driven outward, forcing rack 35 in the direction indicated by the arrow thereon. This effects the clockwise rotation of pinion 33 and therefore of tubular member 27, and also displaces rack 42 in the direction shown which forces hydraulic fluid from cylinder 44.

From an inspection of FIGS. 1 and 2 it will be seen that the clockwise rotation of pinion 33, and therefore of member 27, will necessarily produce a corresponding rotation of lower housing 11 with respect to upper housing 10,

Rotation of the lower housing corresponding to the depicted movement of pinion gear 33 will then procure a lefthand turn of the driven vessel due to the offset thrust by propeller 23. Conversely, had valve 45 been turned in an opposite direction and pressurized fluid directed to cylinder 44, rack 42 would then have been forced outwardly from cylinder 44 to effect clockwise rotation of pinion 33. The corresponding rotation of lower housing 11 would then cause the driven vessel to turn to the right.

Figure 3:
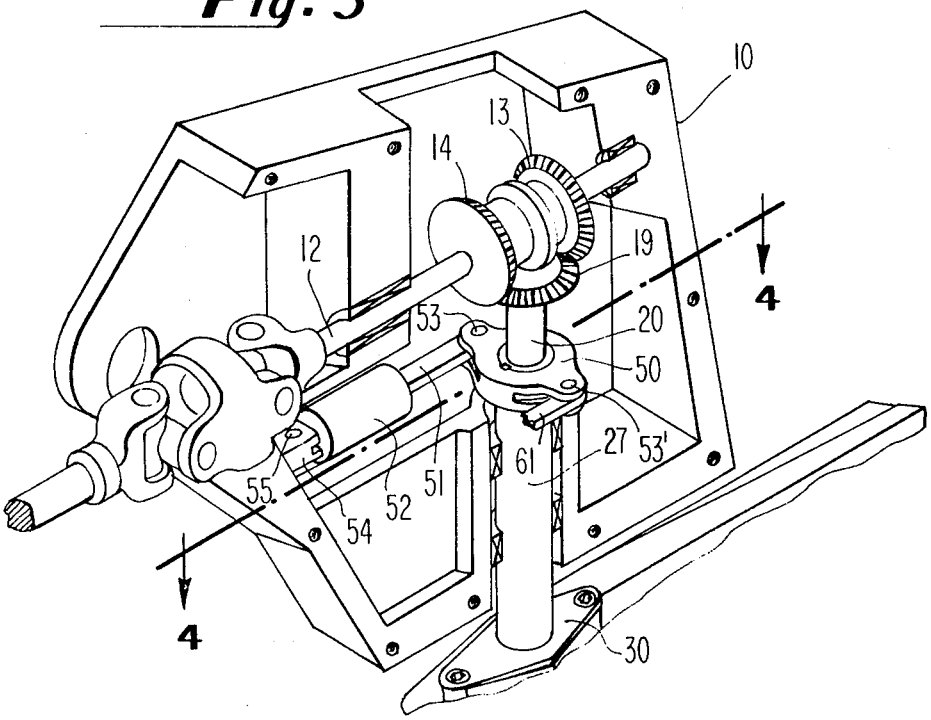
FIG. 3 is a cutaway drawing of a second embodiment of the invention.

Referring now to FIG. 3, there is shown another embodiment of the present invention, disposed in an environment similar to that of FIG. 1. As before, motive power is transmitted through an input shaft 12, which is journaled in a housing 10, to gears 13, 14 for transmitting power of intermediate shaft 20 through a mating bevel gear 19. Tubular member 27 is journaled within upper housing 10, and has a flange 30 disposed at the lower end thereof and adapted to be fixedly mounted to the lower housing 11 (not shown) in the manner described hereinabove.

At the upper end of tubular member 27, and fixedly attached thereto, is a steering means comprising a bellcrank 50. The bellcrank advantageously is formed with a bore sized to slide over tubular member 27, and has a keyway adjacent the bore and formed to match to a similar keyway machined in the tubular member. In this manner, the bellcrank may be coupled to the tubular member so that rotation of the bellcrank will cause the tubular member 27, and therefore the lower assembly of the unit, to turn therewith.

Substantially diametrically opposite one another are a pair of protrusions 50*a*, 50*b* for receiving linkages to be coupled to the bellcrank by suitable means such as bolts or pins. One such linkage, shown at 51, extends from hydraulic cylinder 52 to a horizontally-disposed slot formed in protrusion 50*a* of bellcrank 50. Pin 53 extends through the slotted portion of the bellcrank, encapturing one end of linkage 51. Pin 53 advantageously incorporates a suitable bearing means journaled within linkage 51 or bellcrank 50, to decrease the friction between the bellcrank and the linkage:

The rearward end of cylinder 52 is provided with a planar extension which is rotatably coupled to bracket 54 by means of pin 55. The fit between the pin and the extended portion of the cylinder is such as to allow the cylinder to articulate slightly in response to the changing relationship between the cylinder and the axis of tubular member 27 as the steering member 50 is caused to rotate by linkage means 51.

Figure 4:
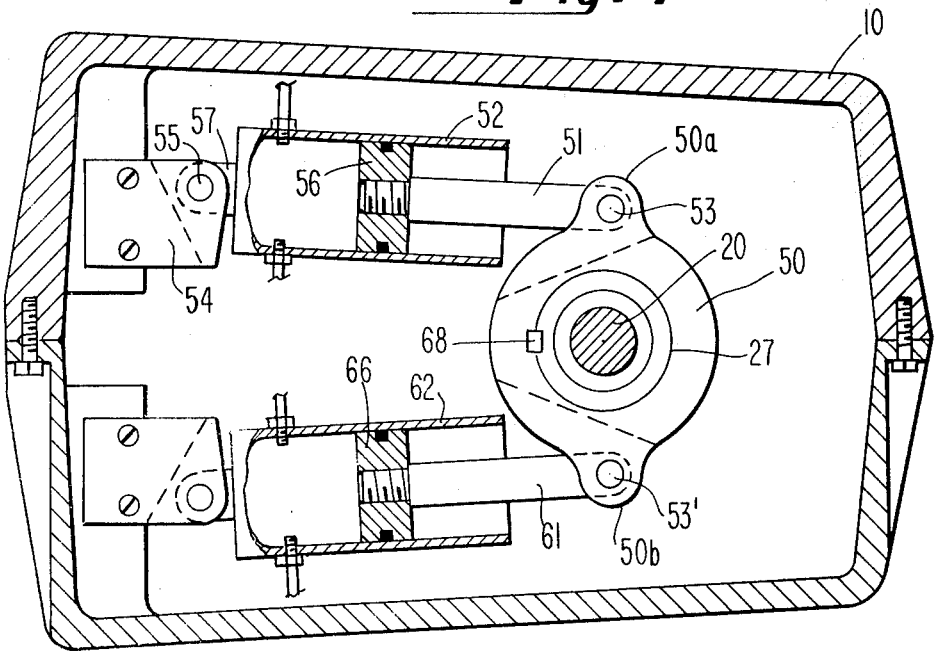
FIG. 4 is a sectional view taken at section 4—4 of FIG. 3.

Turning now to FIG. 4, there is shown bellcrank 50 assembled to a pair of parallel hydraulic cylinder 52, 62 by means of links 51, 61, respectively. The ends of the links remote from the cylinders are coupled to opposite sides of bellcrank 50 by means of pins 53, 53' which are journaled in the bellcrank or links to allow angular rotation of the bellcrank relative to the links. A key 68 is disposed in mating keyways in tubular member 27 and bellcrank 50 to allow the bellcrank to turn in response to pressure exerted on various ones of links 51, 61 by hydraulic cylinders 52 and 62 respectively.

In a preferred embodiment, the links 51, 61 are substantially planar and fit into slots provided in bellcrank 50 which extend generally perpendicular to the axis of tubular member 27. The ends of the links remote from the bellcrank are cylindrical in a cross section and have threads provided thereon for engaging pistons 56, 66 of hydraulic cylinders 52 and 62 respectively.

The closed ends of the hydraulic cylinders have brackets 57 extending outwardly therefrom. Brackets 57 are pivotally coupled to other brackets 54 which are bolted to appropriate bosses cast within upper housing 10 and serve to support the hydraulic cylinders, while allowing them to pivot in order to maintain alignment with pins 53, 53', and so bellcrank 50, as the bellcrank is turned.

The operation of the system shown in FIGS. 3 and 4 in substantially the same as that of FIGS. 1 and 2. In order to cause a driven vessel to turn to the left pressurized hydraulic fluid is forced into cylinder 52 by suitable valving means as depicted in FIG. 2. This causes piston 56 to be driven outwardly, causing bellcrank 50 to turn in a clockwise direction. Similarly, to effect a right turn, pressure is removed from cylinder 52 and introduced into cylinder 62 so as to cause bellcrank 50 to turn in a counterclockwise manner.

It will now be seen that there has been described an improved self-contained steering mechanism for use in an inboard-outboard drive system with advantages not heretofore known in the prior art. The longitudinal disposition of the steering linkage means and the hydraulic cylinders associated therewith, allows the upper housing of the unit to be considerably narrower and more compact than is the case with prior art arrangements. In addition, the overall length of the cylinder/-linkage combination is minimized through the use of a single acting cylinder at one end of a link, the cylinders advantageously being of the economical, single-action variety such that piston return is accomplished in response to the actuation of the opposite cylinder. Further, the described arrangement requires little in the way of complex castings or machining requirements since the cylinders may easily be attached to, and thus form no part of, the upper housing itself.

In addition, it will be seen that the entire cylinder and linkage assembly is entirely enclosed within the confines of the upper housing of the inboard-outboard drive unit, protecting it from injury and from corrosion.

It will now be seen that there has been described herein a superior inboard-outboard drive assembly, incorporating directional control means which avoid many of the problems heretofore found in prior-art designs. The hydraulic mechanisms used to accomplish turning of the lower portion of the two-piece unit are completely enclosed within, and therefore protected by, the upper housing thereby extending the life and improving the reliability of the system. Additional support may be furnished the turning means through the use of complementary racks disposed upon opposite sides of the steering pinion gear, while the drive unit housing configuration necessary for locating and supporting the cylinders and racks is considerably simplified. Finally, the disclosed arrangement results in a considerably more compact steering apparatus, which lends itself both to advanced housings of the "clamshell" configuration, and allows the housing to be substantially narrower than housings using other types of prior art steering arrangements.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed is new and desired to be secured by Letters Patent of the United States is:

1. An inboard-outboard drive unit for marine vessel, comprising:

an upper portion adapted to be tiltably mounted to the stern structure of the vessel and a lower portion rotatably coupled to said upper portion;

first drive means disposed in said upper portion and adapted to be coupled to a source of motive power inboard of said vessel;

second drive means disposed in said lower portion and having propeller means attached thereto;

intermediate drive means coupling said first and said second drive means and comprising a shaft extending from said upper portion to said lower portion;

tubular means journaled in said upper portion and disposed concentrically about said intermediate drive means;

steering means fixedly coupled to said tubular means;

means coupling said tubular means to said lower portion to cause said lower portion to rotate therewith;

first and second self-contained hydraulic cylinder means disposed within said upper portion, said cylinder means being disposed upon the same side of said steering means and substantially parallel to each other;

first and second linkage means extending substantially parallel to one another and coupling said first and said second hydraulic cylinders respectively to points on said steering means located on opposite sides of the axis of said tubular means; and means for selectively actuating said hydraulic cylinder means for effecting rotational movement of said lower portion with respect to said upper portion.

2. The invention defined in claim 1, wherein said steering means is a pinion, and said first and said second linkage means comprise rack gears adapted to engage opposite sides of said pinion.

3. The invention defined in claim 2, further including guide means formed in upper portion, said guide means comprising ways extending substantially parallel to one another and formed in opposite sides of said upper portion for slidably receiving said rack gears.

4. The invention defined in claim 3, wherein said guide means comprise linear grooves.

5. The invention defined in claim 4, wherein said hydraulic cylinder means are single-acting hydraulic cylinders.

6. The invention defined in claim 5, wherein said pinion means and said tubular means are coupled by mating splines formed thereon.

7. The invention defined in claim 6 wherein said upper portion comprises two substantially symmetrical housings, said housings being joined along a plane extending generally parallel to the axes of said first drive means and said intermediate drive means.

8. The invention defined in claim 2, wherein said steering means is a bellcrank and said first and said second linkage means comprise elongate arms pivotally mounted to opposite sides of said bellcrank, and further including means for mounting said first and second cylinders within said upper portion for allowing each of said cylinders to pivot about an axis extending substantially parallel to that of said tubular means.

9. The invention defined in claim 8, wherein said hydraulic cylinder means are single-acting cylinders.

10. The invention defined in claim 9, wherein said tubular member and said bellcrank have complementary keyways formed thereon, and a key disposed in said keyways for non-rotatably coupling said bellcrank to said tubular means.

11. The invention defined in claim 10, wherein said upper portion comprises two substantially symmetrical housings, said housings being joined along a plane extending generally parallel to the axis of said first drive means and said intermediate drive means.

12. An inboard-outboard drive unit for a marine vessel, comprising:

an upper housing adapted to be mounted to the stern of the vessel;

an input shaft journaled in said upper housing and having means for drivingly coupling said input shaft to a source of motive power disposed inboard of the vessel;

a lower housing;

an output shaft journaled in said lower housing and having propeller means associated with one end thereof;

an intermediate shaft extending from said upper housing to said lower housing;

first gear means coupling said input shaft to said intermediate shaft;

second gear means coupling said intermediate shaft to said output shaft;

a tubular element disposed coaxially with said intermediate shaft, said tubular element being rotatably journaled within said upper housing and being non-rotatably associated with said lower housing;

first and second self-contained hydraulic cylinders disposed within said upper housing at a common side of said tubular element;

pinion gear means non-rotatably coupled to the upper end of said tubular element;

first and second rack gears coupling opposing sides of said pinion gear means to said first and said second hydraulic cylinders, respectively; and means for selectively introducing pressurized fluid into said first and said second hydraulic cylinders.

13. The invention defined in claim 12, wherein said first gear means comprises first and second bevel gears disposed on said input shaft and a third bevel gear on said intermediate shaft said first and second bevel adapted to alternately engage said third gear.

14. The invention defined in claim 13, wherein said upper housing is divided into two substantially equal portions, said portions being joined along a plane extending substantially parallel to the axis of said input shaft and said intermediate shaft, each of said portions having formed therein means for mounting ones of said hydraulic cylinders.

* * * * *